United States Patent [19]

Crambes et al.

[11] 4,120,655

[45] Oct. 17, 1978

[54] METHOD FOR THE INHIBITION OF CORROSION OF FERROUS METALS IN AN AQUEOUS MEDIUM

[75] Inventors: Michel Crambes, Villette-de-Vienne; Henri Grangette, Lyon; Pierre Pivette, Sucy-en-Brie; Philippe Haicour, Paris, all of France

[73] Assignee: Societe Nationale Elf Aquitaine, Paris, France

[21] Appl. No.: 814,652

[22] Filed: Jul. 11, 1977

[30] Foreign Application Priority Data

Jul. 13, 1976 [FR] France ..... 76 21471

[51] Int. Cl.[2] ..... C23F 11/12; C23F 11/14; C23F 11/16

[52] U.S. Cl. ..... 422/15; 252/389 A; 422/17

[58] Field of Search ..... 21/2.7 A; 252/392, 396, 252/389 A

[56] References Cited

U.S. PATENT DOCUMENTS

| | | | |
|---|---|---|---|
| 3,518,203 | 6/1970 | Savinelli et al. | 21/2.7 A |
| 3,699,052 | 10/1972 | Petrey et al. | 21/2.7 A |
| 3,714,066 | 1/1973 | King et al. | 21/2.7 A |
| 3,718,603 | 2/1973 | Mitchell | 21/2.7 A |
| 3,723,347 | 3/1973 | Mitchell | 21/2.7 A |
| 3,868,217 | 2/1975 | Hollingshad | 21/2.7 A |
| 3,873,465 | 3/1975 | DiSimone | 21/2.7 A |
| 3,932,303 | 1/1976 | Hollingshad | 21/2.7 A |
| 4,066,398 | 1/1978 | Hwa | 21/2.7 A |

*Primary Examiner*—Morris O. Wolk
*Assistant Examiner*—Bradley Garris

[57] ABSTRACT

The method for the inhibition of corrosion of ferrous metals in an aqueous medium consists in adding to the aqueous medium 10 to 2000 ppm of a mixture constituted by a water-soluble complex salt of a metal of groups II to VIII of the periodic table and of a hydroxycarboxylic acid and by a phosphoric ester of alkanolamine.

6 Claims, 1 Drawing Figure

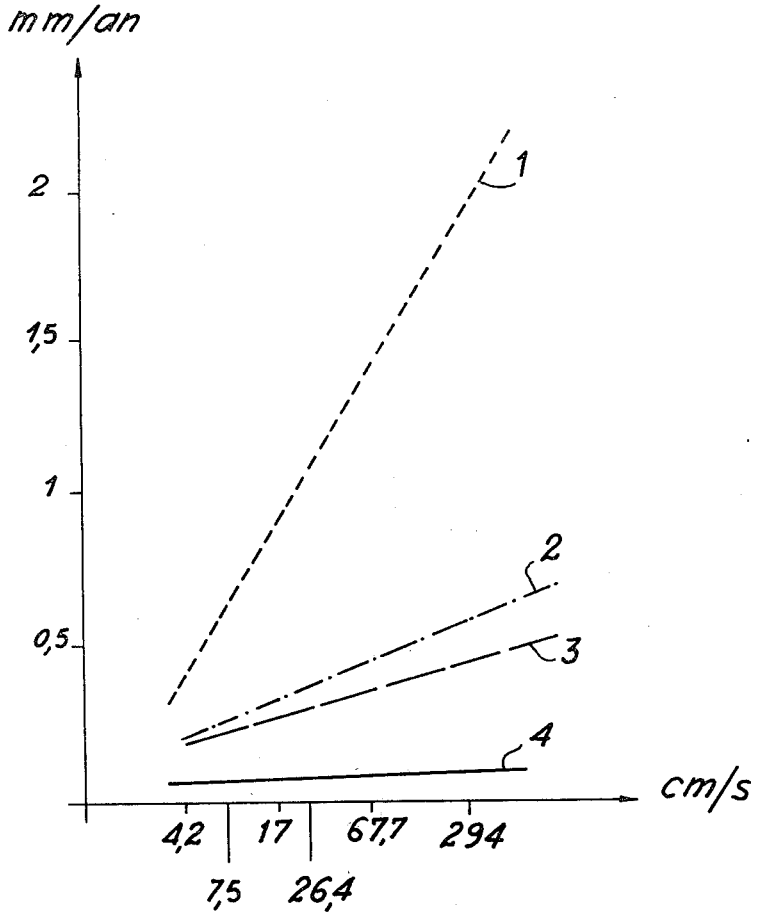
mm/an
2
1,5
1
0,5
1
2
3
4
cm/s
4,2
17
67,7
294
7,5
26,4

METHOD FOR THE INHIBITION OF CORROSION OF FERROUS METALS IN AN AQUEOUS MEDIUM

This invention relates to an improved method for the inhibition of corrosion of ferrous metals in an aqueous medium and especially in a medium which has a high salt content such as sea water, for example.

Water has long been in use as a cooling agent in heat exchange processes in a very wide range of industrial applications. It is known that water has a corrosive action on many metals, this action being related to its chemical nature and to its tendency to dissolve certain gases such as oxygen in particular.

Different additives have already been proposed on account of their power to reduce the corrosion of these metals and especially the corrosion of iron. The action of these additives which are both mineral and organic substances usually consists of a reaction carried out between these latter and the metallic surfaces in order to produce thin films of complexed metal which prevent diffusion of the dissolved gases towards the metallic surfaces. Other techniques have also been proposed for the removal of oxygen by reduction or stripping of the medium.

These different techniques do not prove entirely satisfactory, especially when they are employed in a sea water medium. In point of fact, the presence of chloride ions in the sea water aggravates the problems of corrosion of metals which are already set by the aqueous media.

Studies made by the present Applicants have served to show that corrosion of iron in sea water is essentially an electrochemical process. This corrosion can be characterized by:

iron in which the usual degeneration of passivity takes place as a result of the presence of chloride ions in the medium;

the medium just mentioned which is a practically neutral brine and contains in addition to the chloride ions a not-negligible quantity of other ions having various degrees of activity;

and oxygen which is the diffusing element and the cathodic reduction of which counterbalances the anodic corrosion of the iron.

The present invention has for its object a novel method for the inhibition of corrosion of iron which can be employed both in conventional aqueous media and in media which have a high salt content. The distinctive feature of this method lies in the use of an inhibitor which is both anodic and cathodic and consequently has the effect of inhibiting both of the reactions involved in the corrosion process.

The method under consideration has the further effect of limiting the dangers of localized corrosion which are inherent in oxygenated media by reducing the cathodic currents to values well below the extreme values of intensities of oxygen diffusion.

The invention relates to a method for the inhibition of corrosion of ferrous metals in an aqueous medium which is distinguished by the fact that there are added to the aqueous medium 10 to 2000 ppm of a mixture constituted by a water-soluble complex salt of a metal of groups II to VIII of the periodic table and of a hydroxycarboxylic acid and by a phosphoric ester of alkanolamine.

In order to prepare the salt, there will preferably be employed a metal chosen from iron, nickel, zinc, manganese, cobalt, lead and cadmium and preferably zinc.

In regard to the hydroxycarboxylic acid employed for the preparation of the salt, this latter can be chosen from the different classes of hydroxycarboxylic acids:

monohydroxymonocarboxylic acids such as glycollic acid, lactic acid or salicylic acid. As can readily be understood, the mercaptocarboxylic acids such as thioglycollic or thiolactic acid can be considered as being equivalent to the preceding.

polyhydroxymonocarboxylic acids such as glyceric acid, for example.

monohydroxypolycarboxylic acids such as for example malic acid, citric acid and isocitric acid.

polyhydroxypolycarboxylic acids such as for example tartaric acid and saccharic acid.

Among all these hydroxycarboxylic acids, the choice is preferably given to those which have the highest complexing power, namely the salicylic, tartaric, citric, malic and gluconic acids.

The phosphoric esters which constitute the mixture employed in the method according to the invention are usually prepared by esterification of phosphoric acid by an alkanolamine such as a mono, di, tri alkanolamine, for example.

These methods of esterification are described in particular in French Pat. No. 1018 577 and in the German Pat. No. 930 566. The principal products of the reactions described above correspond to the following formulae:

$$PO_3H_2-O-X-N\begin{matrix}R_1\\R_2\end{matrix} \text{ or } PO_2H-\left[O-X-N\begin{matrix}R_1\\R_2\end{matrix}\right]_2$$

wherein $R_1$ and $R_2$ which may be either identical or different represent either hydrogen or a hydrocarbon radical comprising in some cases a function such as a hydroxyl function, and wherein X is a linear or branched divalent hydrocarbon radical containing 2 to 4 carbon atoms.

The products just mentioned are preferably prepared by esterification of phosphoric acid $H_3PO_4$ by an ethanolamine, for example, such as diethanolamine or triethanolamine.

The mixtures in accordance with the invention will preferably be employed in the form of stable solutions in the medium under treatment in order to ensure full effectiveness of these mixtures.

The choice of the different constituents of the mixture employed in the method is important since it must be realized that certain metal salts such as zinc salts for example are not stable in a neutral or weakly alkaline medium:

the phosphates are precipitated by the alkaline-earth cations in a sea water medium;

finally certain metal salts such as zinc salts in particular precipitate with the phosphates . . .

The method in accordance with the invention is not only more efficacious than those of the prior art but has the further advantage of being of the "safety" type. Thus in contrast to certain other methods, the result thereby achieved is that any accidental decrease in concentration of the mixture in the medium does not give rise to any irreversible process and the corrosion rate can be brought back to its initial level by restoring the concentration of the mixture in the medium.

The method in accordance with the invention is illustrated by means of the following examples which are given without any limitation being implied. In these examples, the corrosion is determined quantitatively by measuring the weight losses of a sample under standardized conditions.

There are introduced in an experimental device on the one hand the corrosive fluid (sea water, ASTM) and on the other hand a sample of iron having known values of mass and surface area. The sea water is circulated by means of a pump which makes it possible to adjust the flow rate to the desired value. The weight of said sample is measured at the end of the experiment after the different deposits have been removed from the sample by brushing and pickling. Corrosion can then be expressed in terms of loss in weight as a function of the time-duration of the experiment or in terms of loss in thickness in respect of corrosion which is assumed to be uniform, this being in any case deduced directly from the weight loss. As a general rule, this value is given in millimeters per year, that is to say the loss in thickness corresponding to an experiment performed over a period of one year (8760 hours).

It must also be noted that the appearance of corroded samples as well as the mass of adherent deposits can provide information. The deposits referred-to are those which are removed by pickling and the mass of which can be determined by weighing the sample after brushing but prior to pickling.

EXAMPLES 1 to 4

In these examples, the measurements relate to the corrosion of a test-bar of polished steel placed in a stream of sea water (ASTM) circulating at a rate of 26.4 cm/s, the temperature above the liquid being 32° C. and the pH of the medium being 8.2.

In Example 1 — used as a reference — the sea water is employed alone.

In Example 2, 100 ppm of a phosphoric ester obtained by reaction of phosphoric acid with diethanolamine are added to the sea water in the form of a solution.

In Example 3, 100 ppm of zinc citrate are added to the sea water in the form of a solution.

In Example 4, 100 ppm of a 50—50 mixture of phosphoric ester of Example 2 and zinc citrate of Example 3 are added to the sea water in the form of a solution.

The results obtained are given in Table I hereunder.

TABLE I

| Examples No | Thickness loss (mm/year) |
|---|---|
| 1 | 1.15 |
| 2 | 0.4 |
| 3 | 0.3 |
| 4 | 0.07 |

These results show that the use of either of the constituents of the mixture improves the corrosion resistance of the sample but that the use of the mixture in accordance with the invention achieves a substantial increase in inhibition of corrosion of iron in the medium.

It can also be observed that the steel sample treated in the presence of the mixture of the two constituents does not show any trace of localized attack after a test carried out over a period of 72 hours.

EXAMPLE 5

The experiments of Examples 1 to 4 are repeated by varying the rate of circulation of sea water. There are plotted in the accompanying FIGURE the straight lines 1, 2, 3, 4 (corresponding respectively to the experiments of Examples 1 to 4) which show the variation in the corrosion rate (mm/year) as a function of the circulation rate (cm/sec). The results obtained show the very high efficiency of the mixture, especially when the circulation rates are of a high order.

EXAMPLES 6 to 9

In these examples, the influence of the method on corrosion which has already started is studied by varying the rate of circulation of the sea water.

The test-pieces consisting of bars of rolled sheet-iron are immersed in sea water which circulates in a closed circuit. The metal-liquid contact surface is perfectly defined by adhesive tape. The circulation rate varies from one test-piece to the other as shown in the accompanying Table II.

As can be observed, the addition of the mixture constituted by zinc citrate and diethanolamine phosphoric ester after 20 hours of corrosion practically stops the incipient corrosion and this latter develops in accordance with a law which is similar to that of the initially inhibited system. This result shows that the inhibitor is active even if it is applied to a metal having a state of surface which has already undergone alteration as a result of corrosion.

EXAMPLE 10

In a series of tests during which the rate of corrosion by electrochemical reaction is measured, the relative proportions of zinc citrate and diethanolamine phosphoric ester are varied.

The work electrode is of mild steel and the corrosive medium consists of sea water in accordance with ASTM standards to which is added a proportion of constant active material.

The results are given in Table III below.

TABLE III

| Test piece | Proportion of phosphoric ester and zinc citrate in the formulation | Proportion of active material | Corrosion rate expressed as current: $10^{-6}$ A/cm$^2$ | Corrosion rate expressed as loss of thickness (mm/year) |
|---|---|---|---|---|
| Reference | 0/0 | 0 | 150 | 1.76 |
| No 1 | 25/75 | 50 ppm | 5.6 | 0.065 |
| No 2 | 50/50 | 50 ppm | 8.7 | 0.102 |
| No 3 | 75/25 | 50 ppm | 6.6 | 0.077 |
| No 4 | 86/14 | 50 ppm | 8.16 | 0.095 |
| No 5 | 94.4/5.6 | 50 ppm | 10.7 | 0.125 |
| No 6 | 97.5/2.5 | 50 ppm | 15.3 | 0.179 |

EXAMPLE 11

The nature of the hydroxycarboxylic acid is caused to vary. The rates of corrosion are calculated on the basis of loss of weight of corrosion test-pieces of soft iron immersed for a period of 125 hours in ASTM sea water which is agitated and aerated.

The results are given in Table IV below.

TABLE IV

| Nature of formulation | Weight loss after 125 hours | Thickness loss (mm/year) |
|---|---|---|
| Check sample in sea water | 111 mg | 0.70 |

TABLE IV-continued

| Nature of formulation | Weight loss after 125 hours | Thickness loss (mm/year) |
|---|---|---|
| 50 ppm Zn citrate + 50 ppm phosphoric ester | 7.1 mg | 0.042 |
| 50 ppm Zn tartrate + 50 ppm phosphoric ester | 5.7 mg | 0.034 |
| 50 ppm Zn salicylate + 50 ppm phosphoric ester | 8.5 mg | 0.051 |

EXAMPLE 12

Corrosion tests are carried out by employing different metallic hydroxycarboxylates.

In these tests, the rates of corrosion of soft-iron corrosion test-pieces immersed for a period of 125 hours in ASTM sea water which is agitated and aerated and to which is added 50 ppm of a metallic hydroxycarboxylate and 50 ppm of diethanolamine phosphoric ester, are then measured.

It is recalled that the rate of corrosion of the check sample immersed in sea water under the same conditions but with addition of a mixture of phosphoric ester and metallic hydroxycarboxylate corresponds to a weight loss of 111 mg after 125 hours.

The results of these tests appear in Table V which shows the weight losses of the test-pieces in mg after 125 hours corresponding to the different metallic hydroxycarboxylates employed, these latter being defined in this table by the nature of the hydroxycarboxylic acid and of the metal from which the metallic hydroxycarboxylate is formed.

TABLE V

| hydroxy-carboxylate | Weight loss in mg after 125 hours (50 ppm of phosphoric ester and 50 ppm of metallic hydroxycarboxylate) metal | | | |
|---|---|---|---|---|
| | Ni | Mn | Co | Pb |
| Salicylate | 26.4 mg | 24.7 mg | 38.8 mg | 35.2 mg |

TABLE V-continued

| hydroxy-carboxylate | Weight loss in mg after 125 hours (50 ppm of phosphoric ester and 50 ppm of metallic hydroxycarboxylate) metal | | | |
|---|---|---|---|---|
| | Ni | Mn | Co | Pb |
| Citrate | 21.2 mg | 27.4 mg | 40.5 mg | 34.4 mg |
| Tartrate | 20.9 mg | 33.9 mg | 36.1 mg | 29.6 mg |

TABLE II

| Rate of circulation cm/s | 0 | 4.24 | 16.95 | 26.43 | 67.7 | 295 |
|---|---|---|---|---|---|---|
| Weight loss in mg/cm$^2$ (free corrosion - 20 hours) | 1.76 | 1.79 | 2.73 | 3.6 | 4.45 | 9.5 |
| Weight loss in mg/cm$^2$ (free corrosion - 93 hours) | 2 | 2.75 | 6.3 | 7.85 | 14.7 | 17.7 |
| Weight loss in mg/cm$^2$ (free corrosion - 20 hours) (then (controlled corrosion - up to 93 hours) | 2.28 | 1.77 | 2.86 | 4.47 | 5.9 | 7.95 |
| Weight losses in mg/cm$^2$ (controlled corrosion - 93 hours) | — | 0.46 | 0.68 | — | — | 0.71 |

What we claim is:

1. A method for the inhibition of corrosion of ferrous metals in an aqueous medium consisting of adding to the aqueous medium from about 10 to 2000 ppm of a mixture consisting essentially of a water-soluble complex salt of a metal of groups II to VIII of the periodic table and of a hydrocarboxylic acid selected from the group consisting of tartaric, citric, maleic, gluconic and salicylic acids together with a phosphoric ester of an alkanolamine.

2. A method according to claim 1, wherein the phosphoric ester of alkanolamine is a phosphoric ester of diethanolamine.

3. A method according to claim 1, wherein the mixture is employed in the form of a solution.

4. A method according to claim 1, wherein the aqueous medium has a high salt content.

5. A method according to claim 1, wherein the metal employed for salifying the hydroxycarboxylic acid is selected from the group consisting of zinc, iron, nickel, manganese, cobalt, cadmium and lead.

6. A method according to claim 5, wherein the salifying metal is zinc.

* * * * *

UNITED STATES PATENT OFFICE
CERTIFICATE OF CORRECTION

Patent No. 4,120,655 Dated October 17, 1978

Inventor(s) Michel Crambes, et al

It is certified that error appears in the above-identified patent and that said Letters Patent are hereby corrected as shown below:

Assignee: SOCIETE NATIONALE ELF AQUITAINE
and
C E C A S.A., both France

Signed and Sealed this
*Twenty-fourth* Day of *April 1979*

[SEAL]

*Attest:*

RUTH C. MASON
*Attesting Officer*

DONALD W. BANNER
*Commissioner of Patents and Trademarks*